US007240461B1

(12) United States Patent
Vandeman et al.

(10) Patent No.: US 7,240,461 B1
(45) Date of Patent: Jul. 10, 2007

(54) SIDING PANELS FOR WALL COVERINGS

(75) Inventors: Ronald L Vandeman, Holmes Beach, FL (US); Dean Jorgenson, Henderson, KY (US)

(73) Assignee: Atlantis Plastics, Inc., Elkhart, IN (US)

( * ) Notice: Subject to any disclaimer, the term of this patent is extended or adjusted under 35 U.S.C. 154(b) by 414 days.

(21) Appl. No.: 10/285,232

(22) Filed: Oct. 31, 2002

Related U.S. Application Data

(60) Provisional application No. 60/334,893, filed on Oct. 31, 2001.

(51) Int. Cl.
*E04D 1/00* (2006.01)
*E04D 3/361* (2006.01)

(52) U.S. Cl. ..... 52/539; 52/314; 52/520; 52/555; 52/557

(58) Field of Classification Search ..... 52/314, 52/555, 557, 558, 519–523, 529–531, 533, 52/539, 526
See application file for complete search history.

(56) References Cited

U.S. PATENT DOCUMENTS 3,217,453 A * 11/1965 Medow ..... 52/314
3,309,831 A 3/1967 Misch et al.
3,473,274 A * 10/1969 Godes ..... 52/127.5
3,485,004 A 12/1969 Mattes
3,593,479 A 7/1971 Hinds et al.
3,897,667 A 8/1975 Turek
4,015,391 A * 4/1977 Epstein et al. ..... 52/520
4,094,115 A * 6/1978 Naz ..... 52/51
4,096,011 A 6/1978 Sanders et al.
4,102,106 A * 7/1978 Golder et al. ..... 52/533
4,186,538 A * 2/1980 Marcum, Jr. ..... 52/521

(Continued)

OTHER PUBLICATIONS

"Cedar Heights Installation Instructions", Alcoa Building Products, Inc., pp. 1-4, 1999.

(Continued)

*Primary Examiner*—Robert Canfield
(74) *Attorney, Agent, or Firm*—Baker & Daniels LLP

(57) ABSTRACT

Siding panels for mounting on a wall surface. Each siding panel includes a plurality of decorative elements integrally formed with the panel and disposed in at least one row, the decorative elements defining a front face of the siding panel; a top edge disposed above the decorative elements; a plurality of apertures formed in and extending through the siding panel disposed below the top edge and above the decorative elements; a bottom end; a plurality of downwardly depending tabs located on the front face of the siding panel, each tab having a plurality of projections; and an upwardly facing channel formed on a side of the siding panel opposite the front face, the channel configured for receipt of the tabs of an adjacent panel. In one embodiment, there are four rounded projections on each tab. The siding panel includes first and second side edges, and a horizontally extending tab. The first side edge may include a tongue, and the horizontally extending tab may be formed on a rear side forming a groove configured to receive the tongue of an adjacent panel. A feature in one embodiment is for the horizontally extending tab to terminate at a distance from the second side edge. The siding panel may include weep holes located in the channel at the bottom end of the siding panel.

18 Claims, 5 Drawing Sheets

U.S. PATENT DOCUMENTS

| | | | | | |
|---|---|---|---|---|---|
| 4,201,024 | A | | 5/1980 | Lafitte, Jr. | |
| 4,223,490 | A | | 9/1980 | Medow | |
| 4,229,916 | A | | 10/1980 | White | |
| 4,251,967 | A | | 2/1981 | Hoofe, III | |
| 4,290,248 | A | | 9/1981 | Kemerer et al. | |
| 4,308,702 | A | | 1/1982 | Rajewski | |
| 4,450,665 | A | * | 5/1984 | Katz | 52/522 |
| 4,476,661 | A | | 10/1984 | Hoofe, III | |
| 4,522,002 | A | | 6/1985 | Davis et al. | |
| 4,593,512 | A | * | 6/1986 | Funaki | 52/519 |
| 4,598,522 | A | | 7/1986 | Hoofe, III | |
| 4,680,911 | A | | 7/1987 | Davis et al. | |
| 4,953,537 | A | | 9/1990 | Allegro | |
| 5,076,037 | A | * | 12/1991 | Crick et al. | 52/520 |
| 5,224,318 | A | | 7/1993 | Kemerer | |
| 5,249,402 | A | | 10/1993 | Crick et al. | |
| 5,295,339 | A | | 3/1994 | Manner | |
| 5,305,570 | A | | 4/1994 | Rodriguez et al. | |
| 5,347,784 | A | | 9/1994 | Crick et al. | |
| 5,388,381 | A | | 2/1995 | Bilinski et al. | |
| 5,461,839 | A | | 10/1995 | Beck | |
| 5,526,627 | A | | 6/1996 | Beck | |
| 5,537,792 | A | | 7/1996 | Moliere | |
| 5,600,971 | A | | 2/1997 | Suk | |
| 5,615,523 | A | | 4/1997 | Wells et al. | |
| 5,630,305 | A | | 5/1997 | Hlasnicek | |
| 5,636,481 | A | | 6/1997 | De Zen | |
| 5,711,126 | A | | 1/1998 | Wells | |
| 5,735,099 | A | | 4/1998 | Anderson | |
| 5,768,844 | A | | 6/1998 | Grace, Sr. et al. | |
| 5,809,731 | A | * | 9/1998 | Reiss | 52/533 |
| 6,170,215 | B1 | * | 1/2001 | Nasi | 52/521 |
| 6,224,701 | B1 | * | 5/2001 | Bryant et al. | 156/73.1 |
| 6,421,975 | B2 | * | 7/2002 | Bryant et al. | 52/528 |
| 6,715,250 | B2 | * | 4/2004 | Bryant et al. | 52/528 |
| 2004/0159062 | A1 | * | 8/2004 | Donlin et al. | 52/506.01 |

OTHER PUBLICATIONS

"Accents Architectural Detail Siding: Half Rounds Authentic Cedar Scallop Design", Atlantis Plastics, 8 pages, undated.

"Accent Panels ALCOA", Alcoa Building Products, Inc., 5 pages, 1993.

"Cedar Impressions", CertainTeed Corporation, 14 pages, undated.

* cited by examiner 10
12
14
16
18
28a
28b
30a
30b
32
34
36
38
38a
40
42a
42b
43a
43b
44
50
56
74a
74b

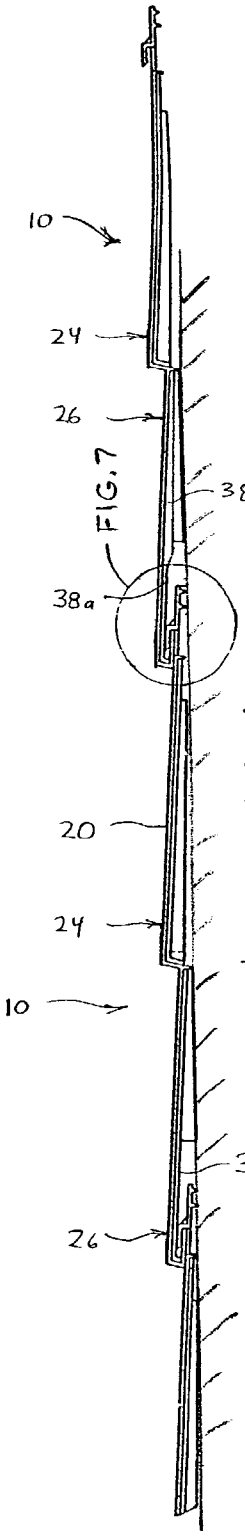
FIG. 4
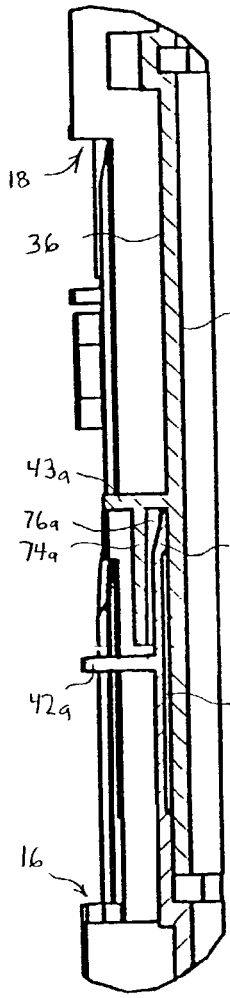
FIG. 5
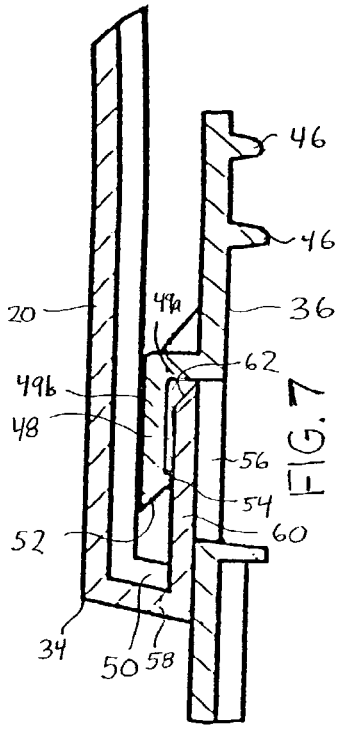
FIG. 7
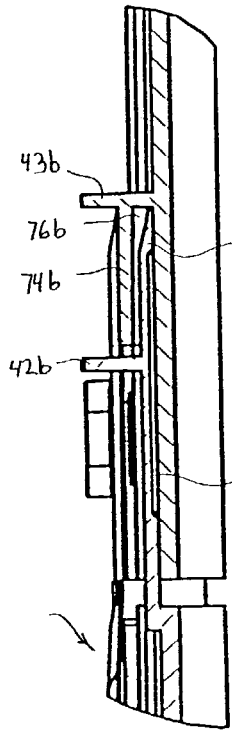
FIG. 6
FIG. 7

SIDING PANELS FOR WALL COVERINGS

BACKGROUND OF INVENTION

This application claims the benefit of U.S. Provisional Patent Application Ser. No. 60/334,893 filed Oct. 31, 2001, the complete disclosure of which is hereby expressly incorporated by reference.

The present invention relates to decorative exterior wall coverings, and in particular, to injection molded siding panels having improved integrally formed attachment elements to facilitate easier installation and functional elements to improve the aesthetics and performance of the panels.

Many types of exterior wall panels are currently known and used in the construction and improvement of residual, commercial, industrial and other buildings. Typically, such panels are formed from a lightweight composite plastic material and are manufactured using conventional extrusion molding, injection molding, impression molding or thermoforming processes. Such panels may be formed in various shapes, such as individual elongated sections similar to standard aluminum siding or single panels incorporating one or more rows of individual decorative elements. Individual panels are often connected to other previously installed, identical panels through a vertical attachment and a horizontal attachment by which portions of the panel to be installed overlap portions of previously installed panels.

Some prior known panel designs employ vertical side and horizontal bottom connections that must be viewed and fitted simultaneously by the installer during installation. A problem with these designs is that the installation of such panels is difficult because the installer can only view one connection at a time. Often the installer would attempt to circumvent this problem by first connecting only the vertical side or the horizontal bottom, only to discover that the remaining connection either cannot be attached, or will cause the initial connection to slip out of place.

In addition, many prior known panel designs have both side and bottom connections that require precise fit. Installation of these panels requiring precise connections may be difficult for several reasons. For example, an entire row of connections may have to be attached along the vertical side or horizontal bottom of a panel, necessitating frequent checking and adjusting as the panel is maneuvered into its installed position. Also, this problem may be exacerbated by the need for such panels to overlap in order to conceal their attachment points. Accordingly, the connections may be hidden from the installer as they are attached during installation. The installer may be forced to either position his head in an awkward viewing position near the wall surface when fitting the panel into position, or even to blindly "feel" the panel into position with his hands by fitting each connection without actually viewing the connections as they are attached. In addition, this difficulty can be exacerbated if vertical side and horizontal bottom connections have to be viewed simultaneously when attached as described above.

Further, some prior panels have employed fastener attachments located on the rear of the panels that have no logical relation to reference elements on the front side of the panel. For example, one prior design comprises a series of tabs spaced at intervals on the rear side of the panels that do not correspond to the arrangement of any elements or reference points on the front side. This problem hampers installation because, as described above, those elements are hidden from the installer during installation and the installer cannot, by simply looking at the front of the panel, identify the locations of the attachment elements on the rear of the panel.

Prior known panel designs have also employed connections that lock firmly into place upon attachment. The problem with such a connection is that they are rigid, and cannot accommodate the inevitable movement associated with thermal expansion or the settling of the underlying wall surface after the panels are installed.

Finally, many prior panel designs have been difficult to cut, trim, or otherwise adjust to fit into tight areas along the wall surface, such as within the gable of a roofline or the area surrounding windows and other surface irregularities. Some existing panels may only be cut in certain structurally designated locations without comprising their overall structural integrity. Other panels are made of materials that are difficult to cut, occasionally requiring certain types of saws and saw blades.

It is therefore an object of the present invention to provide a wall panel that is easy to install. It is a further object of the invention that the panel have sound connections, but will readily allow for the expansion and contraction of the panels without compromising the integrity of the connections or adversely affecting the panels. It is also an object of the invention that the panels may be readily installed by a single installer. Another object of the invention is to provide a panel having features to assist in installing the panels around tight areas such as around a window frame. These and other objects of the invention have been accomplished with a decorative wall panels set forth and described below.

SUMMARY OF THE INVENTION

It is a feature of the present invention to provide an embodiment of a siding panel for mounting on a wall surface wherein the siding panel includes a plurality of decorative elements integrally formed with the panel and disposed in at least one row. The decorative elements define a front face of the siding panel. In one embodiment, the siding panel also includes a top edge disposed above the decorative elements; a plurality of apertures formed in and extending through the siding panel disposed below the top edge and above the decorative elements; a bottom end; a plurality of downwardly depending tabs located on and extending outwardly from the front face of the siding panel, each tab having a plurality of projections; and an upwardly facing channel formed on a side of the siding panel opposite the front face. The channel is configured for receipt of the tabs of an adjacent panel.

Another aspect of the invention is to provide an embodiment wherein the projections on the siding panel are rounded and extend from a back side of the tabs towards the front face. In one embodiment, there are four projections on each tab.

Also, in one embodiment of the invention, the siding panel includes two rows of decorative elements. The decorative elements in the rows are offset from one another. The panel further includes side edges wherein the side edges are offset at in the transition area between the rows.

In another embodiment, the upwardly facing channel has an upwardly extending leg and at least one projection on the upwardly extending leg that extends toward the side of the panel opposite the front face.

Another feature of the invention is to provide an embodiment wherein the siding panel includes first and second side edges, and a horizontally extending tab. The first side edge may include a tongue, and the horizontally extending tab may be formed on a rear face opposite the front face forming a groove configured to receive the tongue of an adjacent panel. In one embodiment, the horizontally extending tab terminates at a distance from the second side edge.

It is another feature of the invention that the siding panel may include weep holes. The weep holes may be located in the channel at the bottom end of the siding panel.

Another feature of the present invention is to provide an embodiment of a siding panel for mounting on a wall surface having a plurality of decorative elements integrally formed with the panel and disposed in at least one row. The decorative elements define a front face of the siding panel. A top edge of the panel is disposed above the decorative elements, and a plurality of apertures are formed in and extend through the siding panel. The apertures are disposed below the top edge and above the decorative elements. The panel has a bottom end, and at least one downwardly depending tab located on the front face of the siding panel. An upwardly facing channel is formed on a side of the siding panel opposite the front face and has at least one weep hole. The channel is configured for receipt of a tab of an adjacent panel.

The upwardly facing channel of the siding panel may include an upwardly extending leg. The weep hole may be located in the upwardly extending leg.

In one embodiment shown, the siding panel has a plurality of the downwardly depending tabs.

It is also a feature of the invention that in one embodiment, the tab may include four rounded projections extending towards the front face.

It is another feature of the invention to provide an embodiment of the siding panel that includes first and second side edges and a horizontally extending tab defining a groove The first edge may include a tongue, and the horizontally extending tab may be formed on the rear face opposite the front face and form a groove configured to receive the tongue formed in the first side edge of an adjacent panel. The horizontally extending tab may be positioned away from the second side edge and terminate at a distance therefrom.

The channel may include a weep hole.

An additional feature of the present invention is to provide an embodiment of a siding panel for mounting on a wall surface wherein the siding panel includes a plurality of decorative elements formed in the panel and disposed in at least one row. The decorative elements define a front face of the panel. The siding panel also has first and second side edges, and the first side edge includes a tongue. A horizontally extending tab may be formed on a rear face opposite the front face such that the tab forms a groove configured to receive the tongue of an adjacent panel. The horizontally extending tab may be positioned away from the second side edge and terminates at a distance therefrom.

The siding panel may include a top edge, a bottom edge, at least one downwardly extending tab located below the top edge, and a channel located at the bottom edge facing upwardly and configured to receive the tab of an adjacent side panel. The tab may include projections extending towards the face.

The projections may be rounded and extend from a back side of the tab. In one embodiment, there are four laterally spaced apart projections on the tab.

Another feature is that the upwardly facing channel may include at least one weep hole.

It is also a feature of the invention to provide an embodiment of a siding panel for mounting on a wall surface wherein the panel includes a plurality of decorative elements integrally formed with the panel, and disposed in at least one row. The decorative elements define a front face of the siding panel. A top edge of the panel is disposed above the decorative elements, and a plurality of apertures are formed in and extend through the siding panel. The apertures are disposed below the top edge and above the decorative elements. The panel also includes a bottom end and at least one downwardly depending tab located on and extending outwardly from the front face of the siding panel. An upwardly facing channel is formed on a side of the siding panel opposite the front face, and the channel is configured for receipt of the tab of an adjacent panel. A plurality of generally vertically oriented ribs are located on the side of panel opposite the front face, and each rib has a section of reduced thickness adjacent the channel to facilitate insertion of the tab of an adjacent panel into the, channel.

BRIEF DESCRIPTION OF THE DRAWINGS

FIG. 4 is a cross-sectional view of the panels taken along line 4-4 of FIG. 1;

FIG. 5 is a cross-sectional view of the side connections between panels taken along line 5-5 of FIG. 1;

FIG. 6 is another cross-sectional view of the side connection between panels taken along line 6-6 of FIG. 1;

FIG. 7 is a close-up of the connection between an upper and a lower panel taken as shown in FIG. 4;

DETAILED DESCRIPTION OF THE PREFERRED EMBODIMENT

Figure 1:
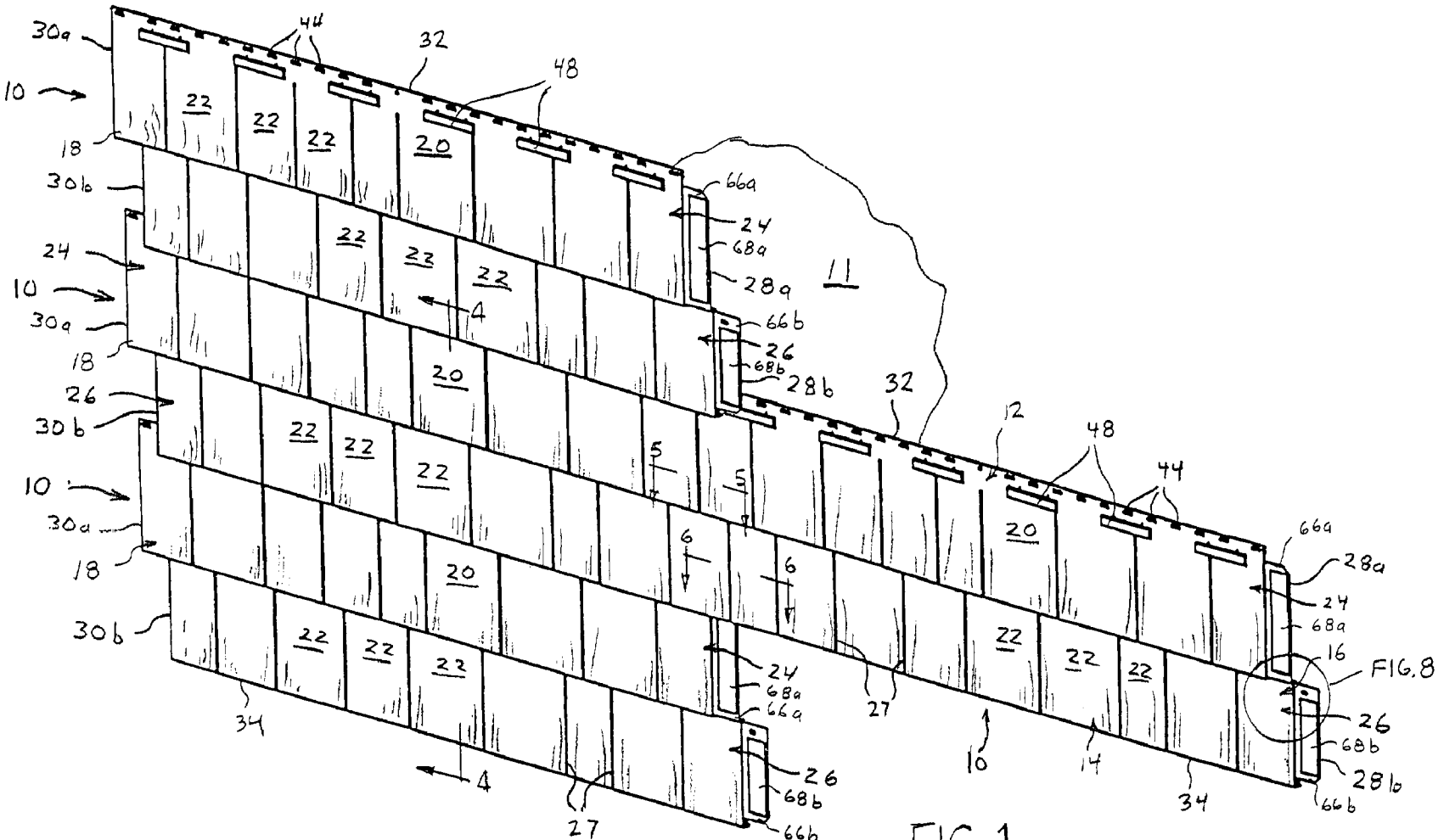
FIG. 1 is a perspective view of the face side of a plurality of panels of the present invention as would appear mounted on a wall surface.
Figures 2, 3, 9:
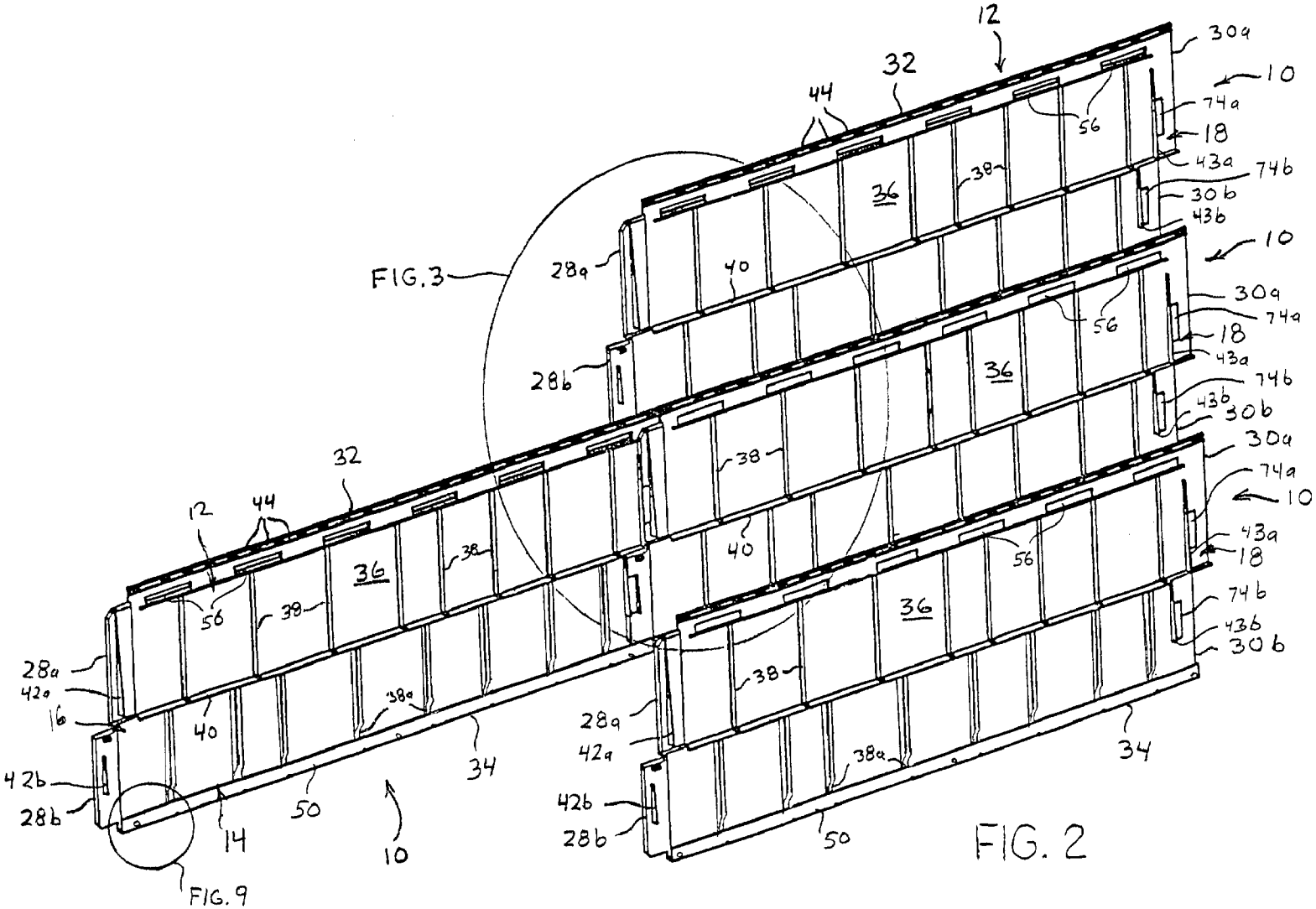
FIG. 2 is a perspective view of the rear side of a plurality of the panels attached to one another.
FIG. 3 is a close up perspective view of the side connections of the present invention taken as shown in FIG. 2.
FIG. 9 is a close up of a weep hole taken as shown in FIG. 2.
Figure 3:
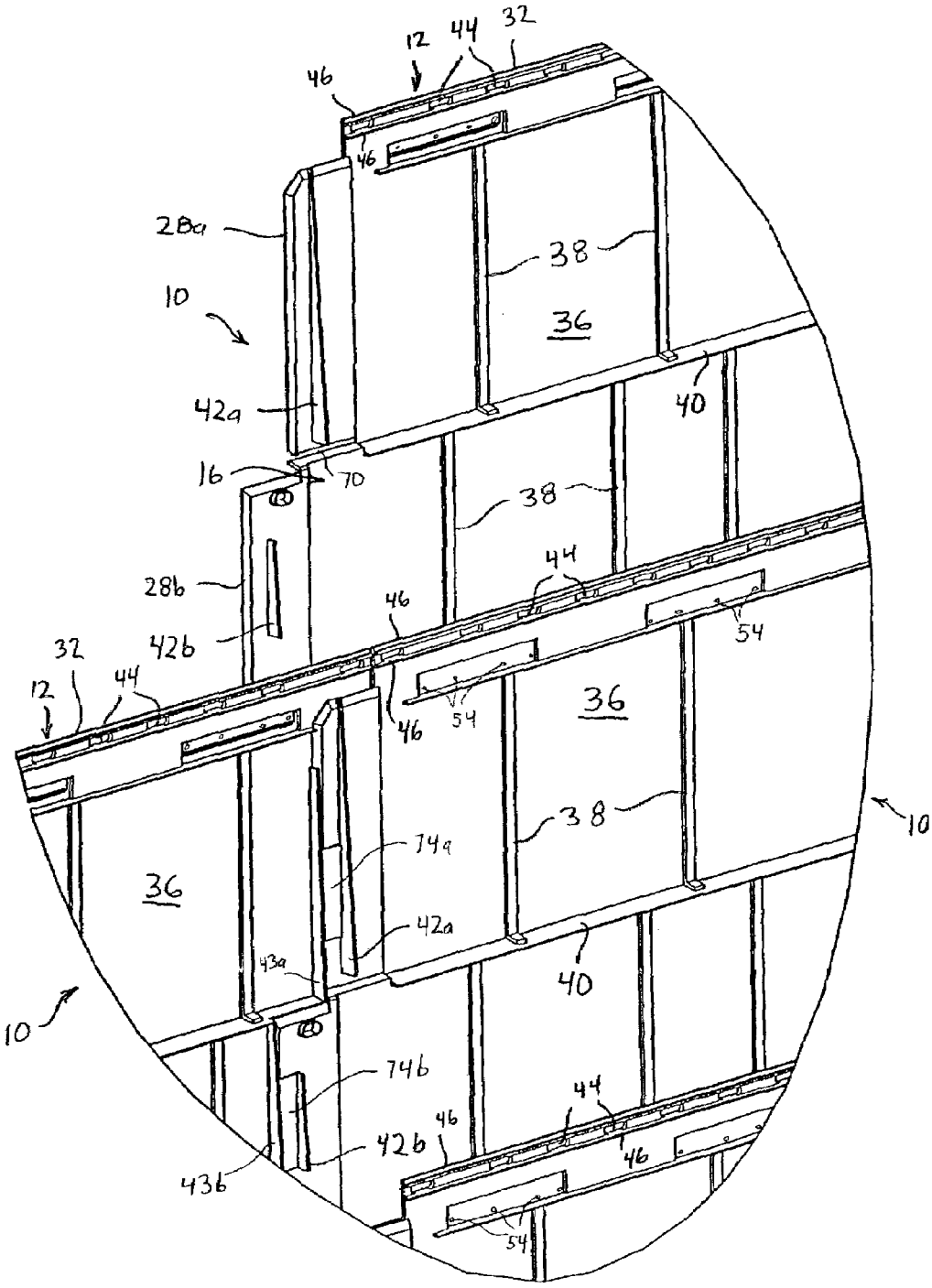

The present invention provides exterior siding panels preferably formed by an injection molding process that are designed to facilitate easy installation and dependable performance. Referring to FIGS. 1 and 2, front and rear perspective views are shown of a plurality of panels generally indicated as 10 as would appear mounted on a wall surface 11. The depictions in FIGS. 1 and 2 show four (4) identical panels connected together. Panels 10 each have a top portion generally indicated as 12, a bottom portion generally indicated as 14, a right-side portion generally indicated as 16 and a left-side portion generally indicated as 18. Panels 10 also include a front face 20 having decorative elements 22, which are arranged in an upper row generally indicated as 24 and a lower row generally indicated as 26. Each decorative element 22 is separated by a gap 27. In the embodiment shown, decorative elements 22 have the appearance of cedar shake siding shingles and may vary in width. Also, the decorative elements 22 on upper row 24 are offset from the decorative elements 22 on the lower row 26 on each panel to enhance the appearance thereof by more closely simulating actual cedar shake siding.

Right-side portion 16 includes side edges 28*a*, 28*b* and left-side portion 18 includes side edges 30*a*, 30*b*. Since the decorative elements 22 are offset between the upper row 24 and lower row 26 as noted above, side edge 28*a*, which coincides with upper row 24, is likewise offset in the transition area from side edge 28*b*, which coincides with lower row 26. Similarly, side edge 30*a*, which coincides with upper row 24, is offset in the transition area from side edge 30*b*, which coincides with lower row 26. The top portion 12 of each panel 10 has a top edge 32, while the bottom portion 14 includes bottom edge 34.

As shown in FIG. 2, panels 10 also include a rear side 36 having a plurality of vertically oriented reinforcing ribs 38 on both the upper and lower rows 24, 26. Reinforcing ribs 38 coincide with gaps 27 formed between decorative elements 22. On the lower rows 26, reinforcing ribs 38 include a section 38*a* towards bottom portion 14 having a reduced thickness. Also located on rear side 36 is a horizontal rib 40 between the upper and lower rows 24, 26 and vertically oriented ridges 42*a*, 42*b* located on right-side portion 16 of upper row 24 and lower row 26, respectively. On left-side portion 18, vertically oriented ridges 43*a*, 43*b* are located on upper row 24 and lower row 26, respectively.

To mount panels 10 on wall surface 11, each panel includes a plurality of nail mounting apertures 44 disposed in a generally horizontal row adjacent top edge 32. In the embodiment shown, the mounting apertures 44 are elongated to accommodate thermal expansion and contraction of the panels. Support ridges 46 (FIG. 3) are located on either side of nailing apertures 44 extending in a general horizontal direction across the panels to side portions 16, 18.

Figure 7A:
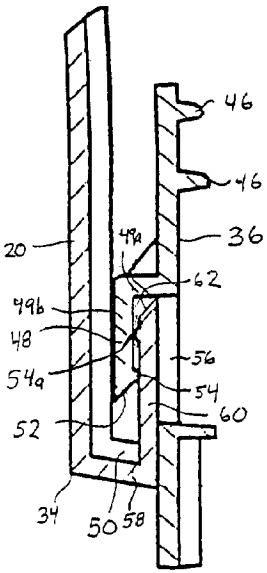
FIG. 7A is a close-up of the connection between an upper and a lower panel taken from FIG. 4 and showing a channel having an alternate configuration.
Figure 9:
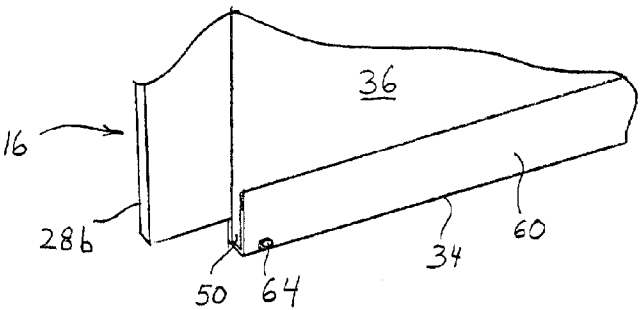

Panels 10 also include a number of features for interconnecting the panels together. For connecting one panel above another, each panel includes a plurality of downwardly depending tabs 48 each having a base 49*a* and a vertical leg 49*b* (FIG. 7). Tabs 48 are located below nailing apertures 44 and above the upper row 24 of decorative elements 22. Panels 10 also include an upwardly facing channel 50 formed along the bottom edge 34 on rear side 36. In the embodiment shown, downwardly depending tabs 48 include a beveled lower edge 52 and a plurality of small rounded projections 54 (FIGS. 3 and 7) extending towards an aperture 56 beneath each tab 48. Upwardly facing channels 50 each include a rearwardly projecting leg 58, and an upwardly extending leg 60 having an upper beveled end 62. Channel 50 also includes a plurality of weep holes 64 (FIG. 9) located at the bottom of upwardly extending leg 60 for allowing any moisture trapped in channel 50 to drain therefrom.

Figure 8:
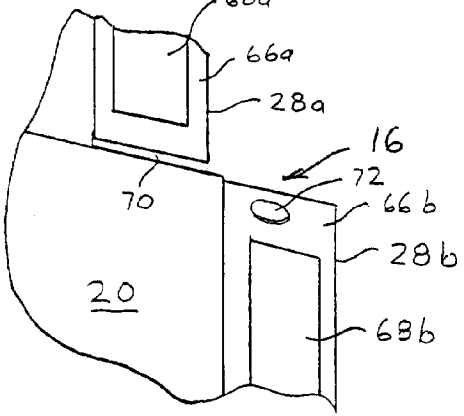
FIG. 8 is a close up view of an installation slot taken from FIG. 1 for ease in assembling the panels around a window or door frame.

To connect side by side panels 10, the right-side portion 16 includes a tongue 66*a* adjacent side edge 28*a* and tongue 66*b* adjacent side edge 28*b*. Tongues 66*a*, 66*b* may each include a cavity 68*a*, 68*b* respectively, for material reduction. Also, between tongues 66*a*, 66*b* and between upper and lower rows 24, 26, a slot 70 as is best shown in FIG. 8 is located to facilitate ease of installing side by side panels. A nailing aperture 72 may also be included on tongue 66*b*.

Referring to FIG. 2, at the left-side portion 18, panels 10 each include a pair of horizontally extending tabs 74*a*, 74*b*. Horizontally extending tab 74*a* is attached to ridge 43*a* and extends toward but terminates short of side edge 30*a* of upper row 24, and horizontally extending tab 74*b* is attached to ridge 43*b* and extends towards but terminates short of side edge 30*b* of lower row 26. Tab 74*a* forms an open channel 76*a* (FIG. 5) facing side edge 30*a* and is configured for receipt of tongue 66*a* on an adjacent panel. Likewise, horizontally extending tab 74*b* forms a channel 76*b* (FIG. 6) open towards side edge 30*b* and is configured for receipt of tongue 66*b* on the adjacent panel.

Installation of panels 10 is preferably started at the lower left-hand corner of wall surface 11. When the first panel is positioned in place, it is secured by using nails (not shown) installed through nail mounting apertures 44 into wall surface 11. The next panel is installed immediately adjacent to the right side of the first panel and is connected thereto by inserting tongues 66*a*, 66*b* of the first panel into channels 76*a*, 76*b*, respectively, of horizontally extending tabs 74*a*, 74*b* respectively. The second panel is then slid to the left if necessary until the appropriate gaps 27*a*, 27*b* (FIG. 1) are achieved between the decorative elements on the first panel and the second panel. It should be noted that the appropriate gap may vary depending upon the temperature which the panels are installed to account for thermal expansion and contraction. Installation lines (not shown) may be included on tongues 66*a* or 66*b* to show the appropriate gap for different installation temperatures to account for thermal expansion and contraction of the panels. When in place, the second panel is secured to wall surface 11 using nails (not shown) placed through nail mounting apertures 44. The sequence is repeated until the bottom row is completed.

For second and subsequent rows of panels, the installation is again commenced at the left side of the wall surface 11 to be covered. Upwardly extending leg 60 of upwardly facing channel 50 is inserted behind the downwardly depending tabs 48 of the panel therebeneath as can be seen in FIG. 7. The beveled lower edge 52 of tab 48 and upper beveled end 62 of upwardly extending leg 60 facilitate the easy insertion of tab 48 into channel 50. The projections 54 on tab 48 help provide a snug fit between the tab and channel so that the upper panel may be momentarily held in place without any securing nails. The fit is not so snug, however, so as to prevent sideward movement/sliding of the upper panel to move it into the appropriate installation spot. It should be noted that the reduced sections 38*a* on reinforcing ribs 38 also facilitate the easy installation of downwardly depending tabs 48 into channel 50. The final vertical position of the upper panel is located by pushing the panel upwards until upper beveled end 62 of upwardly extending leg 60 bottoms out against the base 49*a* of tabs 48 as can be seen in FIG. 7.

Subsequent panels may be installed by interconnecting the panels with the adjacent panel to the left and below using the same techniques as described above. Slots 70 may be used to allow a panel to be brought in at an angle and then rotated into the proper position to be secured. Of course, once each panel is in place, it is secured to wall surface 11 using nails (not shown) installed through nail mounting apertures 44. In this manner, wall surface 11 may be covered with panels 10 to provide an attractive, durable and secure covering.

While the invention has been taught with specific reference to these embodiments, someone skilled in the art will recognize that changes can be made in the form and detail without departing from the spirit and scope of the invention. For example, although panels 10 have been shown having a simulated cedar shake siding appearance, other decorative designs may be substituted for decorative elements 22 such as simulated brick, tile, stucco, wood, or other siding. Furthermore, although the embodiment shown utilizes two decorative rows per panel, the invention may be used with more or less rows. In addition, the number of downwardly depending tabs 48 and horizontally extending tabs 74*a*, 74*b* may be increased or reduced beyond that depicted in the drawings. A single downwardly depending tab 48 may also be used that extends completely across the face of panel 10. Likewise, more or less rounded projections 54 may be used or the shape and configuration may be altered. In addition, projections 54*a* may be placed on upwardly extending leg 60 of channel 50 in lieu of or in addition to projections 54 as shown in the alternate embodiment in FIG. 7A.

It should also be appreciated that the left-side panel on each row may be trimmed to provide a more staggered, random appearance of the cedar shakes as is known in the art. Also, other materials or processes may be used to manufacture the panels. Therefore, the scope of the invention is indicated by the following claims rather than by the description or figures shown.

The invention claimed is:

1. A siding panel for mounting on a wall surface, comprising a plurality of decorative elements integrally formed with said panel and deposed in at least one row, said decorative elements defining a front face of said siding panel; a top edge disposed above said decorative elements; a plurality of apertures formed in and extending through said siding panel disposed below said top edge and above said decorative elements; a bottom end; a plurality of downwardly depending tabs located on and extending outwardly from said front face of said siding panel, each tab having a plurality of rounded projections extending from a back side of said tabs back towards said front face; and an upwardly facing channel formed on a side of said siding panel opposite said front face, said channel configured for receipt of a tab of an adjacent panel.

2. The siding panel as set forth in claim 1, wherein there are four projections on each tab.

3. The siding panel as set forth in claim 1, wherein there are two rows of decorative elements.

4. The siding panel as set forth in claim 3, wherein said decorative elements in said rows are offset from one another and further including side edges wherein said side edges are offset at a transition between said rows.

5. The siding panel as set forth in claim 1, wherein, said upwardly facing channel includes an upwardly extending leg and said leg includes at least one projection extending back to said side of said siding panel opposite said front face.

6. The siding panel as set forth in claim 1, wherein said upwardly facing channel includes at least one weep hole.

7. The siding panel as set forth in claim 6, wherein, said upwardly facing channel includes an upwardly extending leg, said weep hole being located in said upwardly extending leg.

8. A siding panel for mounting on a wall surface, comprising a plurality of decorative elements integrally formed with said panel and deposed in at least one row, said decorative elements defining a front face of said siding panel; a top edge disposed above said decorative elements; a plurality of apertures formed in and extending through said siding panel disposed below said top edge and above said decorative elements; a bottom end; a plurality of downwardly depending tabs located on and extending outwardly from said front face of said siding panel, each tab having a plurality of projections; an upwardly facing channel formed on a side of said siding panel opposite said front face, said channel configured for receipt of a tab of an adjacent panel; and first and second side edges, and a horizontally extending tab, said first side edge including a tongue, said horizontally extending tab formed on a rear face opposite said front face and forming a groove configured to receive said tongue of an adjacent panel, and said horizontally extending tab terminating at a distance from said second side edge.

9. A siding panel for mounting on a wall surface, comprising a plurality of decorative elements integrally formed with said panel and disposed in at least one row, said decorative elements defining a front face of said siding panel; a top edge disposed above said decorative elements; a plurality of apertures formed in and extending through said siding panel disposed below said top edge and above said decorative elements; a bottom end; a plurality of downwardly depending tabs located on said front face of said siding panel, said tabs including vertical legs and projections extending towards said front face on a back side of said vertical legs; and an upwardly facing channel formed on a side of said siding panel opposite said front face and having at least one weep hole, said channel configured for receipt of said tabs of an adjacent panel.

10. The siding panel as set forth in claim 9 including four rounded projections on each of said tabs.

11. The siding panel as set forth in claim 9, including at least one projection extending from an upwardly extending leg of said channel on said side of said siding panel opposite said front face.

12. A siding panel for mounting on a wall surface, comprising a plurality of decorative elements integrally formed with said panel and disposed in at least one row, said decorative elements defining a front face of said siding panel; a top edge disposed above said decorative elements; a plurality of apertures formed in and extending through said siding panel disposed below said top edge and above said decorative elements; a bottom end; at least one downwardly depending tab located on said front face of said siding panel; an upwardly facing channel formed on a side of said siding panel opposite said front face and having at least one weep hole, said channel configured for receipt of said tabs of an adjacent panel; and first and second side edges and a horizontally extending tab defining a groove, said first edge including a tongue, said horizontally extending tab formed on the rear face opposite said front face and forming a groove configured to receive the tongue formed in said first side edge of an adjacent panel, and said horizontally extending tab terminating at a distance from said second side edge.

13. The siding panel as set forth in claim 12, wherein said panel includes two rows and said side edges include an offset at the transition area between said rows.

14. A siding panel for mounting on a wall surface comprising of a plurality of decorative elements formed in said panel and disposed in at least one row, said decorative elements defining a front face of said panel; first and second side edges, said first side edge including a tongue; and a horizontally extending tab formed on a rear face opposite said front face and forming a groove open towards said second side edge and configured to receive a tongue of an adjacent identical panel, said horizontally extending tab terminating at a distance from said second side edge, the siding panel including a top edge, a bottom edge, at least one downwardly extending tab located below said top edge,and a channel located at said bottom edge facing upwardly and configured to receive said tab of an adjacent side panel, said tab including projections extending towards said front face.

15. The siding panel as set forth in claim 14, wherein said projections are rounded and extend from a back side of said tab.

16. The siding panel as set forth in claim 15, wherein there are four laterally spaced apart projections on the tab.

17. The siding panel as set forth in claim 14, wherein the upwardly facing channel includes at least one weep hole.

18. A siding panel for mounting on a wall surface, comprising a plurality of decorative elements integrally formed with said panel, disposed in at least one row, said decorative elements defining a front face of said siding panel; a top edge disposed above said decorative elements;

a plurality of apertures formed in and extending through said siding panel disposed below said top edge and above said decorative elements; a bottom end; at least one downwardly depending tab located on and extending outwardly from said front face of said siding panel; an upwardly facing channel formed on a side of said siding panel opposite said front face, said channel configured for receipt of said tab of an adjacent panel; and a plurality of generally vertically oriented ribs on said side of panel opposite said front face, each rib having a section of reduced thickness adjacent said channel to facilitate insertion of said tab of an adjacent panel into said channel.

* * * * *